US005787936A

United States Patent [19]

Snipes

[11] Patent Number: 5,787,936

[45] Date of Patent: Aug. 4, 1998

[54] LAMINATED PAPERMAKER'S FABRIC HAVING PROJECTING SEAMING LOOPS

[75] Inventor: F. Lee Snipes, Vancouver, Wash.

[73] Assignee: Asten, Inc., Charleston, S.C.

[21] Appl. No.: 755,230

[22] Filed: Nov. 22, 1996

[51] Int. Cl.[6] ..... D21F 1/00

[52] U.S. Cl. ..... 139/383 AA; 139/383 A; 442/270; 162/900; 162/904; 162/348

[58] Field of Search ..... 139/383 AA, 383 A; 442/270, 247; 162/900, 904, 358.2, 348

[56] References Cited

U.S. PATENT DOCUMENTS

| | | | |
|---|---|---|---|
| 3,815,645 | 6/1974 | Codorniu . | |
| 4,364,421 | 12/1982 | Martin | 139/383 AA |
| 4,403,632 | 9/1983 | Romanski et al. | 139/383 AA |
| 4,476,902 | 10/1984 | Westhead | 139/383 AA |
| 4,824,525 | 4/1989 | Penven . | |
| 4,865,083 | 9/1989 | Cunnane . | |
| 4,892,781 | 1/1990 | Penven . | |
| 4,896,702 | 1/1990 | Crook . | |
| 4,902,383 | 2/1990 | Penven . | |
| 4,911,683 | 3/1990 | Legge et al. . | |
| 5,031,283 | 7/1991 | Aldrich . | |
| 5,053,109 | 10/1991 | Penven . | |
| 5,092,373 | 3/1992 | Lee . | |
| 5,117,865 | 6/1992 | Lee . | |
| 5,503,196 | 4/1996 | Josef et al. | 139/383 |
| 5,507,915 | 4/1996 | Durkin et al. | 162/902 |
| 5,601,691 | 2/1997 | Kufferath | 162/900 |

*Primary Examiner*—Andy Falik
*Attorney, Agent, or Firm*—Volpe and Koenig, P.C.

[57] ABSTRACT

An industrial conveying fabric having a laminated multi-layer construction. The laminated fabric includes a first fabric having a tubular configuration that is flattened and a second open flat fabric disposed within the first tubular fabric. The opposed ends of the second fabric project through the first fabric and are joined together to seam the laminated fabric. Preferably, the laminated fabric is used as a base fabric for a papermakers wet press felt and has fibrous batting material needled thereto.

15 Claims, 2 Drawing Sheets

LAMINATED PAPERMAKER'S FABRIC HAVING PROJECTING SEAMING LOOPS

BACKGROUND OF THE INVENTION

1. Field of the Invention

The present invention relates to industrial fabrics such as conveying fabrics used in papermaking. More particularly, it relates to the combination of an endless woven fabric and an open flat fabric to form a laminated multilayer fabric which can be used, for example, as a base fabric for a wet press felt.

2. Description of the Prior Art

Papermakers fabrics are used to form, transport, dewater and dry paper on a papermaking machine. Papermakers press felts are designed to transport an aqueous web of paper through the press rollers of a papermaking machine and to assist in the dewatering of the paper web. Commonly, a papermakers wet press felt is constructed from a woven base fabric having fibrous batt material needled to one or both sides.

The amount of void volume within the base fabric of a press felt is directly related to the amount of water which can be handled internally by the felt as it conveys the paper web through press nips. Felts which can be run without water puddling behind the nip are less likely to result in crushing or damage to the aqueous web. In some cases, multilayered base fabrics are provided to enhance the void volume of the press felts. Papermakers fabrics may be made by endless weaving without a seam. In such cases, when a fabric is installed, the operating machinery has to be partially dismantled so that the fabric can be slipped onto the machine from the side. This is a slow and cumbersome method of installation since endless wet felts are relatively heavy and stiff and are commonly several meters wide and over 30 meters long. Moreover, not all papermaking equipment is designed to permit installation of non-seamed fabrics.

To simplify installation, press fabrics having seams have gained acceptance. It is easier to thread a flat, open-ended fabric through a papermaking machine and then join the fabric's opposing ends together in a seam on the machine, than it is to perform the cumbersome task of installing a non-seamed fabric.

A variety of seams and seaming methods are known in the art. Flat woven fabrics have been constructed with an independent seam structure attached to the ends of the fabric, such as by sewing a woven tape onto the fabric or utilizing clipper hooks. Additionally, papermaking fabrics are commonly formed with loops of yarn projecting from the fabric ends, the loops from both ends of the fabric are intermeshed and joined together by inserting a pintle wire or pin through the intermeshed end loops to secure the ends together. Other conventional fabric seams have also included the use of separately attached loop materials such as helical coils, spiral wires or metal clips. Various prior art seams are disclosed in U.S. Pat. Nos. 3,815,645; 4,824,525, 4,865,083; 5,053,109 and 5,117,865 which illustrate seams for woven fabrics constructed using either flat or endless weaving techniques.

It is desirable to provide a laminated multilayer fabric which provides good void volume and combines the ease of installation of a flat woven fabric while maintaining some of the fabric characteristics of an endless woven fabric.

SUMMARY OF THE INVENTION

The present invention is directed to a laminated multilayer industrial conveying fabric which is constructed by combining an endless fabric with an open flat fabric. The flat fabric is disposed within the interior of the endless fabric which is collapsed to define a flat sandwiched laminated construction. Accordingly, the laminated multilayer fabric includes top and bottom laminate layers defined by portions of the endless fabric and an intermediate laminate layer defined by the flat fabric. Each laminate layer may in turn include one or more woven layers dependent upon the weave structure selected for the endless and open flat fabrics which are used in the construction of the composite laminated fabric. Although the two component fabrics are preferably woven fabrics, non-woven fabrics, such as fabrics formed of spiral yarns linked together, may also be used.

The ends of the flat fabric include interconnecting means such as seaming loops. The flat fabric has a predetermined length determined by the size of the endless fabric such that the seaming loops or other interconnecting means project through the endless fabric at opposing ends of the laminated multilayer fabric. In use, the laminated multilayer fabric is threaded through the serpentine path of the conveying apparatus, such as a papermaking machine, and the opposing ends are seamed together by joining the projecting ends of the interior flat fabric.

The laminated fabric design has utility as an industrial conveying fabric where a relatively high caliper or multilayer fabric is desired such as for press felts and corrugator belts. Preferably, the laminated fabric is employed as a base fabric for a wet press felt. In finishing such a press felt, batting material may be needled on to one or both sides of the multilayer base fabric structure. A method for constructing the laminated fabric is also disclosed.

An object of the present invention is to provide a laminated multilayer fabric for papermaking and other industrial uses. It is also an object to provide such a fabric in which a pin seam may be formed quickly and economically in a fabric that is engineered to have desirable characteristics.

Other objects and advantages of the present invention will be evident to those skilled in the art from the following description of a presently preferred embodiment.

DESCRIPTION OF THE PREFERRED EMBODIMENT

Figure 1:
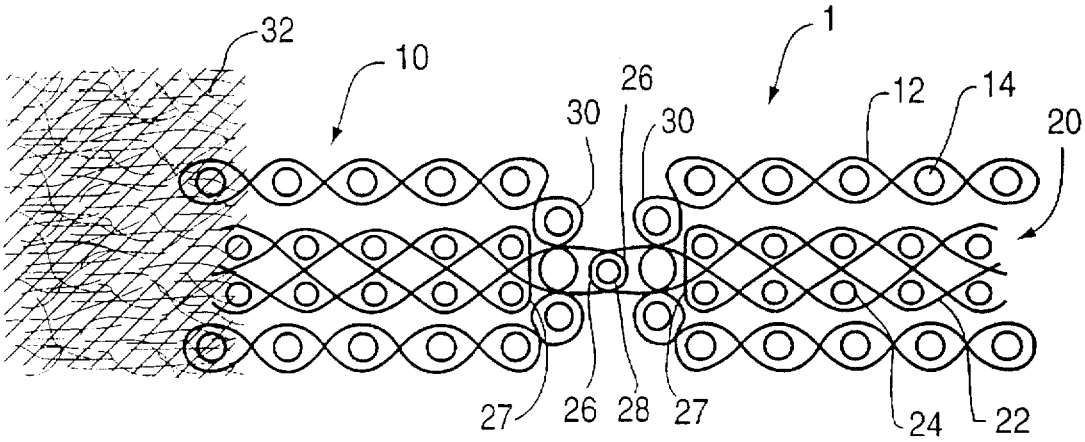
FIG. 1 is a detailed section view of a laminated fabric according to the present invention.

The preferred embodiment will be described with reference to the drawing figures where like numerals represent like elements throughout.

In describing the woven portions of the fabric herein, reference is made to the orientation of the yarns as used on a papermaking or other type of machine. Yarns oriented along the direction of travel of the fabric are referred to as machine direction or MD yarns; yarns which are transverse to the direction of the machine travel are referred to as cross machine direction or CMD yarns.

Figure 2:
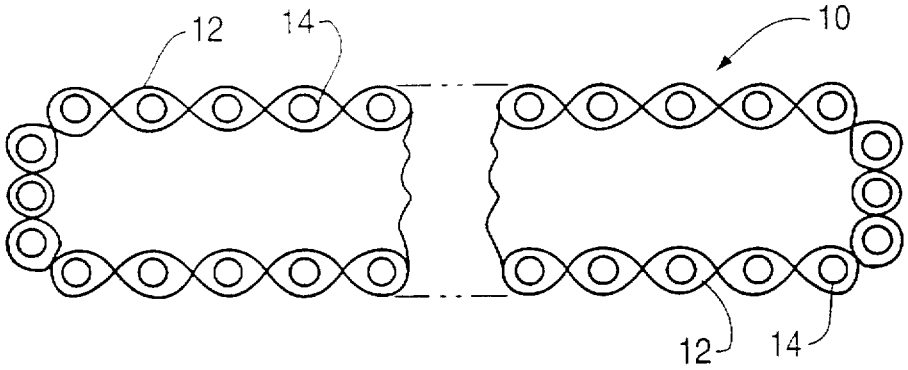
FIG. 2 shows a first step of assembly of the fabric shown in FIG. 1.

A preferred embodiment of a laminated fabric 1 of the present invention and a method for making the fabric 1 are illustrated in FIGS. 1–5. The laminated fabric 1 is constructed by combining a first endless fabric 10 with a second flat fabric 20. As best seen in FIG. 2, the first fabric 10 is woven to have a seamless tubular form in a conventional endless weaving process having MD yarns 12 and CMD yarns 14. Preferably, the first fabric 10 has a single layer weave with MD yarns 12 weaving in a simple plain weave, an over one and under one repeat pattern, with respect to CMD yarns 14. A double or triple layer weave may be substituted for the single layer weave to provide the laminated fabric 1 with addition void volume and caliper.

The second fabric 20 is an open flat fabric having MD yarns 22 and CMD yarns 24 interwoven in a conventional two CMD layer weave pattern. Preferably, every other MD yarn 22 is used to form a seaming loop 26 to define arrays of seaming loops 26 at both ends of the second fabric 20. The non-loop forming MD yarns are woven to retain the endmost CMD yarns 24. Although a double CMD layer construction is preferred, single or other multiple layer designs can also be incorporated depending upon the desired characteristics for the interior of the laminated fabric.

Figure 4:
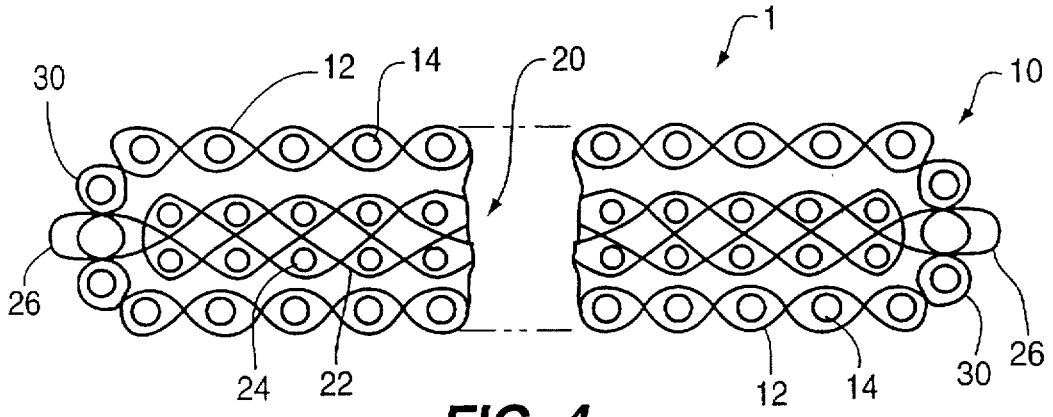
FIG. 4 shows a third step of assembly of the fabric shown in FIG. 1.

As best shown in FIGS. 1 and 4, the flat second fabric 20 is disposed within the interior of the endless woven first fabric 10 in a flat sandwich construction with the flat fabric's end loops 26 projecting through the endless fabric 10. Accordingly, the laminated multilayer fabric 1 includes top and bottom laminate layers defined by portions of the endless fabric 10 and an intermediate laminate layer defined by the flat fabric 20.

When combined with the flat fabric 20, the endless first fabric 10 forms a laminated flat fabric of substantially half the length of the endless first fabric 10. As described more fully below in describing the method of construction, at each end 19 of the collapsed first fabric 10, selected CMD yarns 15 are removed to enable the second fabric's end loops 26 to project through the first fabric 10. Accordingly, the ends of the laminated fabric are seamed by intermeshing the projecting second fabric end loops 26 and inserting a pintle yarn 28 through the intersecting loops as shown in FIG. 1.

When the laminated fabric 1 is used as a wet press felt base fabric, fibrous batt material 32 is applied to one or both sides thereof. A conventional needling process is used to attach the batting 32 to the laminated fabric 1. The needling also serves to bind the laminate layers together. Alternatively, batting can be applied by affixing the batt material 32 with an appropriate adhesive or resin. In alternate embodiments, sewing or stitching of the batt material 32 to the laminated fabric 1 is also possible. Once batting is applied, the fabric can be processed, for example, as taught in U.S. Pat. No. 4,902,383, to provide a uniform seam construction.

Construction of the laminated fabric 1 begins with endless weaving of fabric 10 to form a tubular fabric as shown in FIG. 2. The second fabric 20 is constructed in an open form with seaming loops 26 projecting from each end. The second fabric 20 may be flat woven with the seaming loops 26 formed by back weaving as illustrated in U.S. Pat. No. 5,092,373. Alternatively, the flat second fabric 20 may be made via endless weaving having the seaming loops 26 formed during the weaving process such as disclosed in U.S. Pat. No. 5,053,109. The first fabric 10 and second fabric 20 are preferably heat set after weaving in a conventional manner to stabilize their weave structure.

Both the first fabric 10 and the second fabric 20 are formed with the same width. The length of the second fabric 20 is carefully controlled in relation to the length of the endless fabric 10 such that the second fabric seaming loops 20 will properly project through the first fabric 10 while maintaining a uniform laminated structure without folds or buckles in the body of the laminated fabric. The length of the second fabric 20 is substantially half the circumferential length of the first fabric 10.

The first and second fabrics 10, 20 may be woven with yarns made of any of the common textile fiber polymeric materials, such as nylon, polyester, polyolefin and the like, as well as mineral and natural fibers. Specialty yarns of heat resistant material, steel, carbon or other alloys and polymers or a combination of polymers may also be used for specialized applications. The yarn structure itself may be defined by a single yarn such as a monofilament, or may be formed of several monofilaments, such as twisted or braided yarn. Staple fiber yarns and multifilament yarns may also be used.

In a preferred embodiment, the first fabric 10 is made of nylon CMD yarns having a 0.015 inch diameter woven 15 CMD yarns per inch and cabled nylon MD yarns, preferably 0.008/2/3 (6 ply cabled), woven 23 MD yarns per inch. A preferred construction of the second fabric 20 entails the use of nylon MD yarns having a 0.019 inch diameter woven 35 MD yarns per inch and two layers of nylon CMD yarns having a 0.019 inch diameter woven 17 CMD yarns per inch in each layer.

Figure 3:
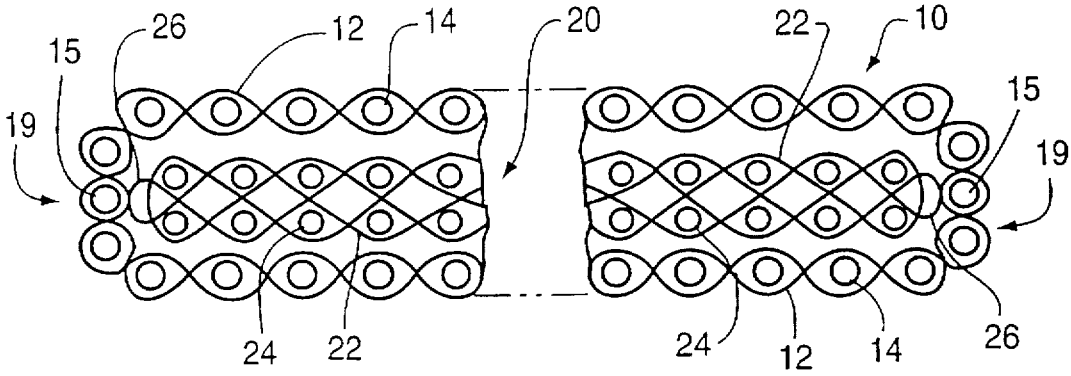
FIG. 3 shows a second step of assembly of the fabric shown in FIG. 1.

As shown in FIG. 3, the second fabric 20 is inserted into the interior of the first fabric 10. Referring to FIGS. 3 and 4, with the endless fabric 10 in a collapsed state, opposing folds or bends are formed to define opposing ends 19 of the collapsed structure. Selected CMD yarns 15 are removed in the area of the end folds 19 of the first fabric 10 in order to permit the second fabric end loops 26 to project therethrough. The related CMD yarns 15 may be manually stripped by hand. The number of CMD yarns 15 which are removed is dependent upon the size and spacing of the CMD yarns 15 in the first fabric 10 and the caliper of the second fabric 20. Preferably, the CMD yarn removal defines relatively vertically flat end surfaces 30 on the first fabric 10 which are butted together during seaming. Upon removal of the selected CMD yarns 15, the seaming loops 26 of second fabric 20 project as shown in FIG. 4. Preferably, the assembled laminated fabric is stitched at approximately 6 and 12 inches from its respective ends to secure the laminate layers defined by fabrics 10, 20 together. At approximately 12 inches from each end, six rows of yarn are stitched at 8.5 stitches per inch, such that the stitch points are embedded between the yarns on both surfaces of the laminated fabric 1. An additional row of stitching is then installed between the six rows of stitches and the ends of the laminated fabric 1. This insures that the component fabrics 10 and 20 will be restrained in a homogeneous structure.

Figure 5:
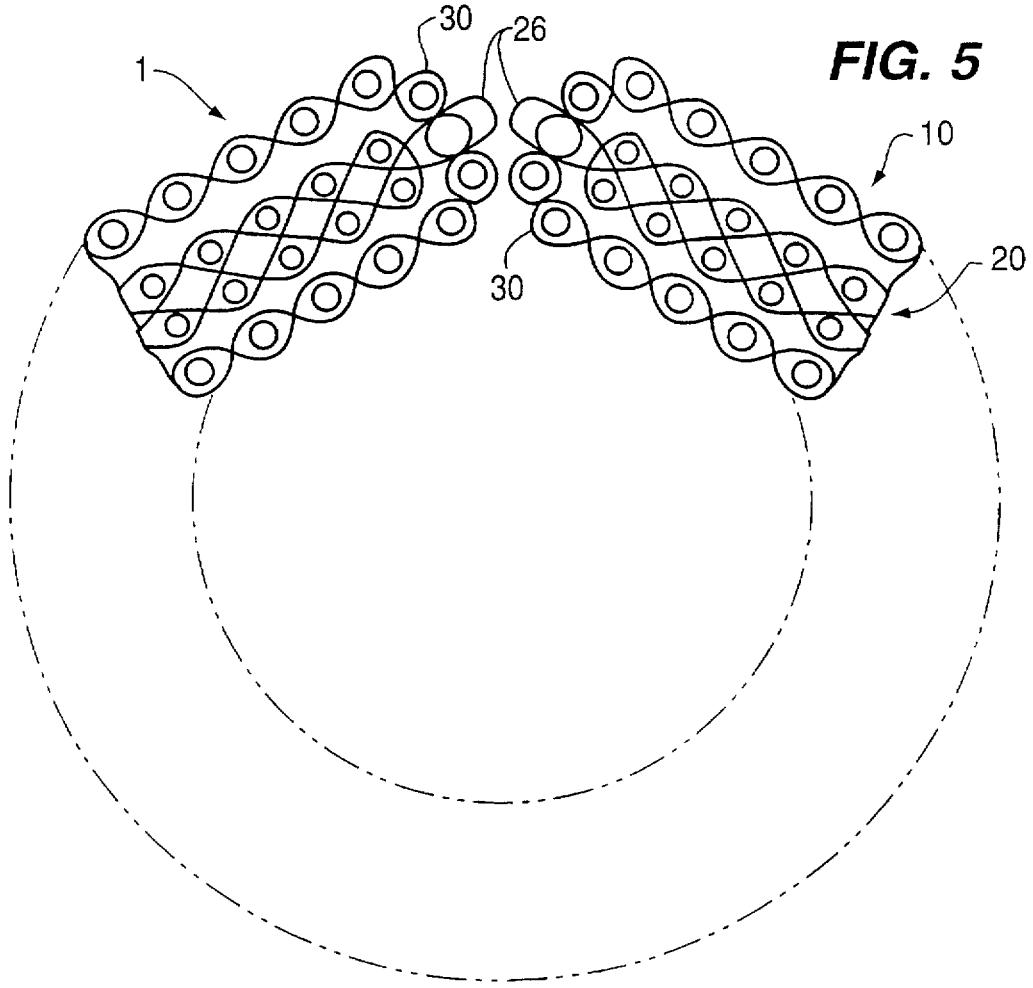
FIG. 5 shows a fourth step of assembly of the fabric shown in FIG. 1.

As shown in FIG. 5, the two ends of the laminated fabric 1 are folded over to bring the loops 26 into close proximity to each other. The loops 26 are then intermeshed and a pintle wire or pin 28 is inserted through the loops 22 to seam the laminated fabric 1, as shown in FIG. 1. This causes the vertical surfaces 30 defined in the collapsed endless fabric 10 to become substantially butted together, preferably with at most a gap no greater than 0.015 inches between the two end surfaces 30. In this form, the laminated fabric 1 is approximately one-half the length of the endless fabric 10 as depicted in FIG. 2. The fibrous batting 32 is then needled onto the laminated fabric 1 to finish the press felt.

While the present invention has been described in terms of the preferred embodiment, other variations which are within the scope of the invention as outlined in the claims will be apparent to those skilled in the art.

I claim:

1. A laminated industrial fabric comprising:

a first fabric having a tubular construction;

a second fabric having a flat open construction with opposing ends;

each end of said second fabric including means for interconnecting said ends to each other;

said second fabric disposed within said first endless fabric to define a laminated fabric body having outer laminate layers defined by said first fabric and an interior laminate layer defined by said second fabric such that neither said first or second fabrics have yarns which are interwoven with both said inner and outer laminate layers of said laminated fabric body; and said interconnecting means of said second fabric projecting through said first fabric whereby interconnection of said second fabric ends renders the laminated fabric body endless.

2. A fabric according to claim 1 wherein said interconnecting means comprise end loops formed on each end of said second fabric.

3. A fabric according to claim 2 wherein said first fabric is an endless woven fabric having interwoven MD and CMD yarns and wherein selected CMD yarns are removed from said first fabric to permit said second fabric end loops to project through said first fabric.

4. A fabric according to claim 2 wherein said end loops of each end of said second fabric are intermeshed with each other and further comprising a pintle disposed within the intermeshed end loops thereby rendering the laminated fabric body endless.

5. A fabric according to claim 2 wherein said second fabric is a woven fabric having interwoven MD and CMD yarns and said end loops are formed from some of the MD yarns of said second fabric.

6. A fabric according to claim 5 wherein said second fabric is made by using an endless weaving process and said end loops are formed in conjunction with the endless weaving process.

7. A fabric according to claim 5 wherein said second fabric is flat woven and said end loops are formed by back weaving selected second fabric MD yarns.

8. A fabric according to claim 1 further comprising fibrous batt material needled onto at least one side of said laminated fabric body.

9. A fabric according to claim 1 wherein stitching is selectively applied to said laminated fabric body to maintain the laminate layers together.

10. A papermakers press felt comprising:

a base fabric including:

a first endless woven fabric having interwoven MD and CMD yarns in a tubular construction;

a second fabric having a flat open construction having opposing ends with end loops for interconnecting the opposing ends of said second fabric to each other; and said second fabric disposed within said first endless fabric to define a laminated fabric body such that said second fabric's end loops project through said first fabric at opposing ends of said laminated fabric body; and fibrous batt material affixed to said laminated fabric body.

11. A papermakers press felt according to claim 10 wherein said laminated base fabric further includes selected stitching to secure laminate layers of said laminated fabric body together.

12. A papermakers press felt according to claim 10 wherein said batt material is needled onto at least a paper carrying side of said laminated base fabric.

13. A method for making a laminated fabric comprising the steps of:

providing a first fabric having a tubular configuration and a second fabric having a flat open construction;

forming seaming loops on said second fabric such that said second fabric has a selected length determined by the circumferential length of said first fabric;

inserting said second flat fabric within the tubular configuration of said endless first fabric to define a uniform laminated fabric body having opposing ends defined by the second fabric end loops projecting through said first fabric.

14. The method of claim 13 further comprising the steps of endless weaving said first fabric from MD and CMD yarns and removing selected CMD yarns from said first fabric to permit the projection of said second fabric end loops through said first fabric.

15. The method of claim 14 further comprising intermeshing said projecting end loops and inserting a pintle to render said laminated fabric body into an endless form.

* * * * *